US005116134A

United States Patent [19]

Edwards et al.

[11] Patent Number: 5,116,134

[45] Date of Patent: May 26, 1992

[54] AUTOMATED PAINT PRODUCTION APPARATUS

[75] Inventors: Kenneth N. Edwards, Glendale; Edward D. Edwards, Healdsburg, both of Calif.; Philip C. Howlett, Wheaton; Niles M. Dwyer, Park Ridge, both of Ill.

[73] Assignee: Fluid Management Limited Partnership, Wheeling, Ill.

[21] Appl. No.: 590,662

[22] Filed: Sep. 28, 1990

[51] Int. Cl.[5] ..... B01F 11/00; B01F 15/02

[52] U.S. Cl. ..... 366/208; 366/605

[58] Field of Search ..... 366/208, 209, 210, 211, 366/212, 213, 214, 215, 216, 217, 218, 219, 348, 349, 605; 99/348, 277.2, 360, 361, 367

[56] References Cited

U.S. PATENT DOCUMENTS

| | | | |
|---|---|---|---|
| 2,010,220 | 8/1935 | Cocks | 366/208 |
| 4,134,689 | 1/1979 | Sorensen | 366/211 |
| 4,596,469 | 6/1986 | Huntsinger | 366/219 |
| 4,789,245 | 12/1988 | Morbeck | 366/605 |

*Primary Examiner*—Robert W. Jenkins

*Attorney, Agent, or Firm*—Fitch, Even, Tabin & Flannery

[57] ABSTRACT

An automated apparatus for mixing ingredients stored in closed containers includes a gyroscopically mounted frame with a clamping arrangement for clamping a container therein. A shuttle moves back and forth between a conveyor and the frame carrying containers to and from the frame. An injection arm carried on the shuttle moves the container into the frame, and an ejection arm moves the container from the frame to the shuttle, for return to the conveyor. A braking alignment mechanism orients the frame to receive a container.

33 Claims, 8 Drawing Sheets

AUTOMATED PAINT PRODUCTION APPARATUS

BACKGROUND OF THE INVENTION

1. Field of the Invention:

The present invention pertains to apparatus for the automated production of paint and other materials which are dispensed into a container, and with closure of the container, are mixed by agitating the container.

2. Description of the Related Art:

Many industrial products are produced by combining ingredients into a shipping or storage container, sealing the container and then mixing the contents thereof. For example, pulverulent or liquid products are readily amenable to such production techniques. In the paint industry, for example, a can, pail or other suitable container is filled with a paint base material. Thereafter, one or more tinting agents are injected or otherwise added to the base material. It is important that the ingredients of a paint formulation be thoroughly mixed to provide a uniform color value throughout the container contents.

Tinting of a paint base material may be performed at a local business establishment conveniently accessible to an end user, using materials and formulations provided by a paint manufacturer. The tinting agents are added to a paint base material, and the container is then sealed and inserted into a mixing apparatus which shakes or otherwise moves the container to mix the contents thereof. Such mixing may be performed, for example, by bench top units or floor mounted units, both of which are manually operated by store personnel who ensure that the container is adequately sealed and securely clamped within the mixing apparatus, and who set the desired amount of time for a mixing operation. At the end of the mixing cycle, the operator unclamps the container from the apparatus and presents the container to the end user, with no further operations being required in most cases.

Examples of manually operated mixing equipment are given in U.S. Letters Pat. No. 4,134,689 and U.S. Design Pat. No. 254,973. In these patents a floor mounted machine is provided for receiving a container to be mixed. An operator adjusts a motor-operated clamping mechanism to ensure an adequate clamping force is applied to the container. Next, the operator initiates a mixing cycle and thereafter unclamps and removes the container from the apparatus.

However, paint is also manufactured by tinting base material in a mass production facility. Such "factory formulations" are important, for example, when large quantities of a formulated paint are required, or when certain quality controls are required, especially for unusual paint formulations. Also, depending upon the distribution system and other factors, additional economies of production are possible only with large-scale factory operations.

U.S. Pat. application Ser. No. 432,991, filed Nov. 6, 1989, the disclosure of which is incorporated in this application as if fully set forth herein, describes a commercial scale paint production facility in which paint is dispensed in batches to achieve various advantages, such as improved quality control over the paint formulation on an individual container basis, and for reduced waste of the paint materials which are used in the course of a production run. Further advantages are obtained in the production facility since the entire paint formulation operation can be fully automated. For example, the containers are provided with bar-code indicia which contain paint formulation and other information such as the size of the container and customer information associated with an order for the paint material. In order to preserve the economies of a fully automated paint production facility, an automated mixing of the containers at a rate consistent with commercial production operations, is required.

SUMMARY OF THE INVENTION

It is an object according to the present invention to provide an automated mixing apparatus for containers filled with pulverulent or liquid materials.

Another object according to the present invention is to provide an automated mixing apparatus which can receive a series of containers from a conveyor line.

A further object according to the present invention is to provide an automated mixing apparatus which employs a gyroscopic motion to mix the contents of a container.

A further object according to the present invention is to provide alignment and braking systems for the automated apparatus to assist in the smooth and rapid delivery of containers to and from the apparatus.

These and other objects according to the present invention, which will become apparent from studying the appended description and drawings, are provided in an automated apparatus for mixing ingredients stored in closed containers, comprising:

a frame means defining a container receiving cavity;

frame support means for movably supporting the frame means for movement in a mixing motion;

shuttle means for carrying a container to said frame, including a shuttle platform for supporting the container and shuttle moving means for moving said shuttle platform toward and away from said frame means;

inserting means for inserting a container carried by said shuttle platform into the cavity of said frame means;

clamping means for clamping the container within said frame means to maintain engagement therewith during a mixing operation;

drive means for moving said frame means with a mixing motion so as to agitate the contents of a container clamped therein; and ejecting means for ejecting the container from said frame means onto said shuttle platform.

Other objects according to the present invention are obtained in an automated apparatus for use in a production facility to mix the liquid ingredients stored in series of closed containers, comprising:

conveyor means for transporting a series of containers through the production facility, the conveyor means including first and second portions spaced apart to form a gap therebetween;

frame means adjacent the main conveyor defining a container receiving cavity;

frame support means for movably supporting the frame means for movement in a mixing motion;

shuttle means for carrying a container from said main conveyor to said frame means, including a shuttle platform in the gap between the first and second conveyor portions for receiving the container from the first conveyor portion, for supporting the container for movement to and from the frame means and for returning the container to the second conveyor portion, and said shuttle means further comprising shuttle moving means for moving said shuttle platform between said conveyor and said frame means;

inserting means for inserting a container carried by said shuttle means into the cavity of said frame means;

clamping means for clamping the container within said frame means to maintain engagement therewith during a mixing operation;

drive means for moving said frame means with a mixing motion so as to agitate the contents of a container clamped therein; and means for ejecting the container from said frame means onto said shuttle platform.

BRIEF DESCRIPTION OF THE DRAWINGS

In the drawings, wherein like elements are referenced alike.

DETAILED DESCRIPTION OF THE PREFERRED EMBODIMENT

Figure 1:
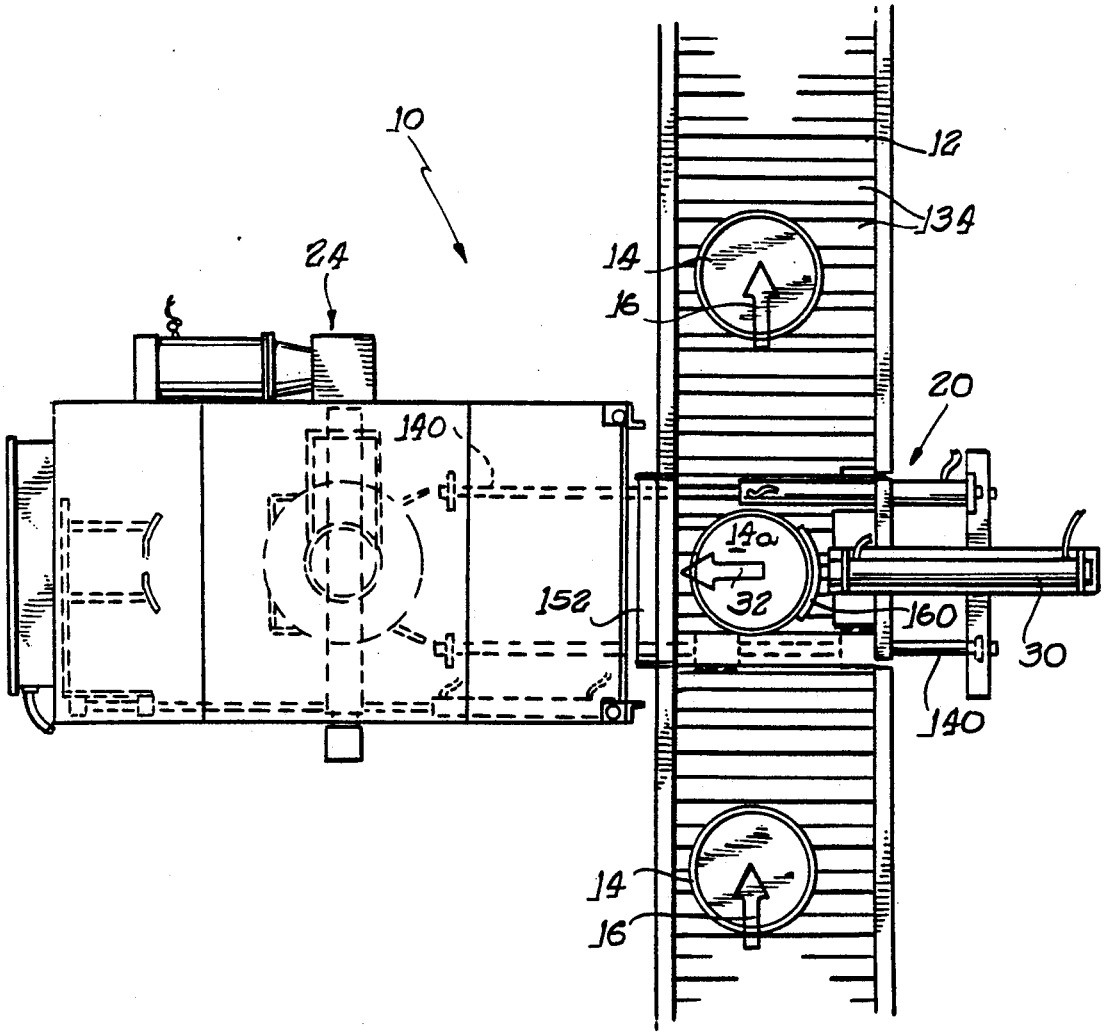
FIG. 1 is a top plan view of an automatic mixing station illustrating principles according to the present invention.

Referring now to the drawings, and initially to FIG. 1, an automatic mixing station according to principles of the present invention is generally indicated at 10. The mixing station 10 is located along a system conveyor 12 which moves liquid-filled containers 14 in the downstream direction of arrow 16. The containers 14 may be of virtually any size, and filled with virtually any fluid or pulverulent material which can be mixed in the closed container by shaking, agitating or otherwise moving the container. As will be seen herein with reference to FIG. 7, the preferred mixing apparatus moves the containers 14 with a gyroscopic motion.

The mixing station 10 includes a shuttle generally indicated at 20 which moves containers, such as the container 14*a* of FIG. 1 toward and away from a mixing apparatus generally indicated at 24. As will be seen herein, shuttle 20 includes an insertion actuator 30 which advances a container 14*a* carried on the shuttle in the direction of arrow 32, toward mixing apparatus 24.

Figure 3:
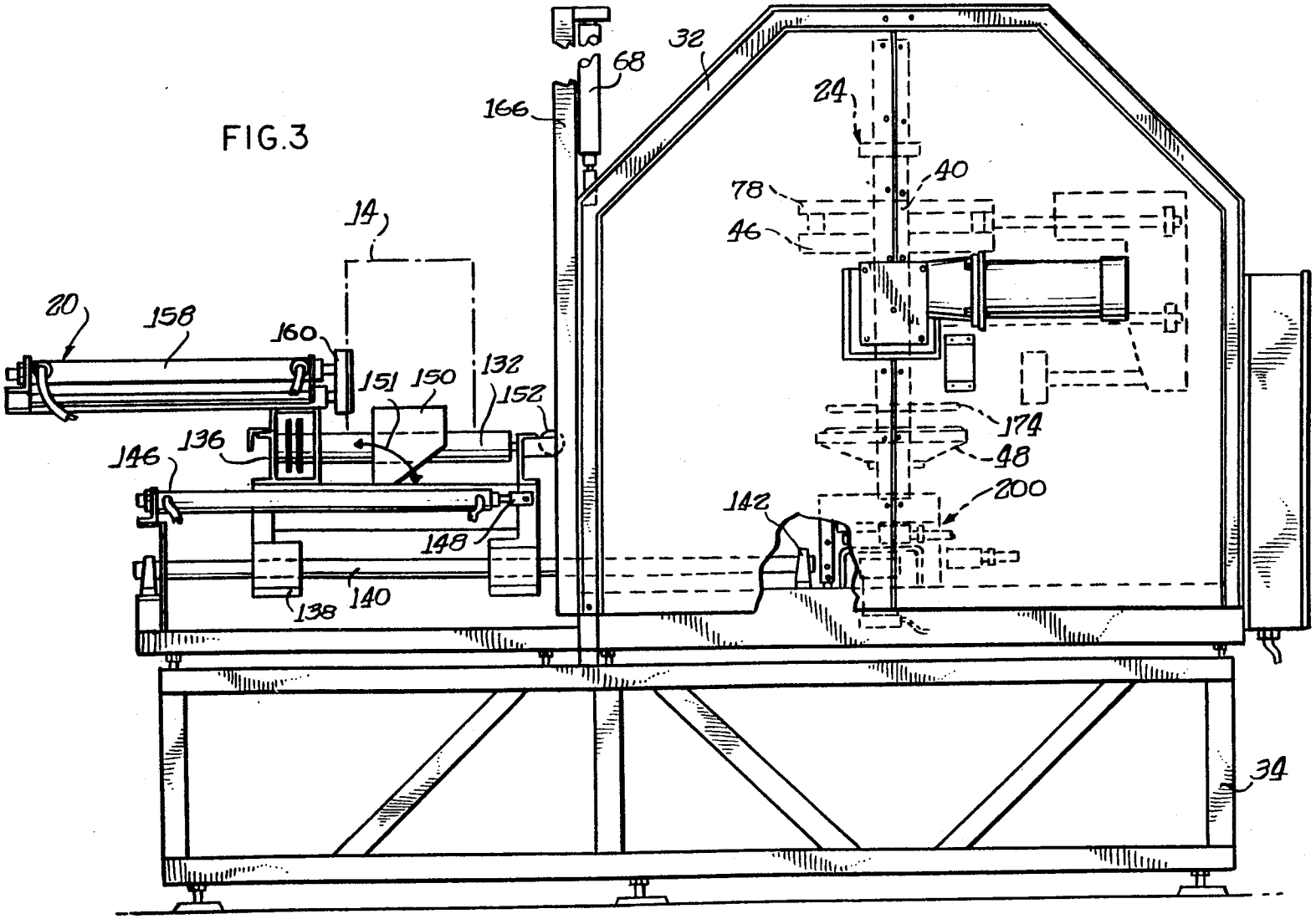
FIG. 3 is a side elevational view of the automatic mixing station of FIG. 1, taken from a downstream position.
Figure 4:
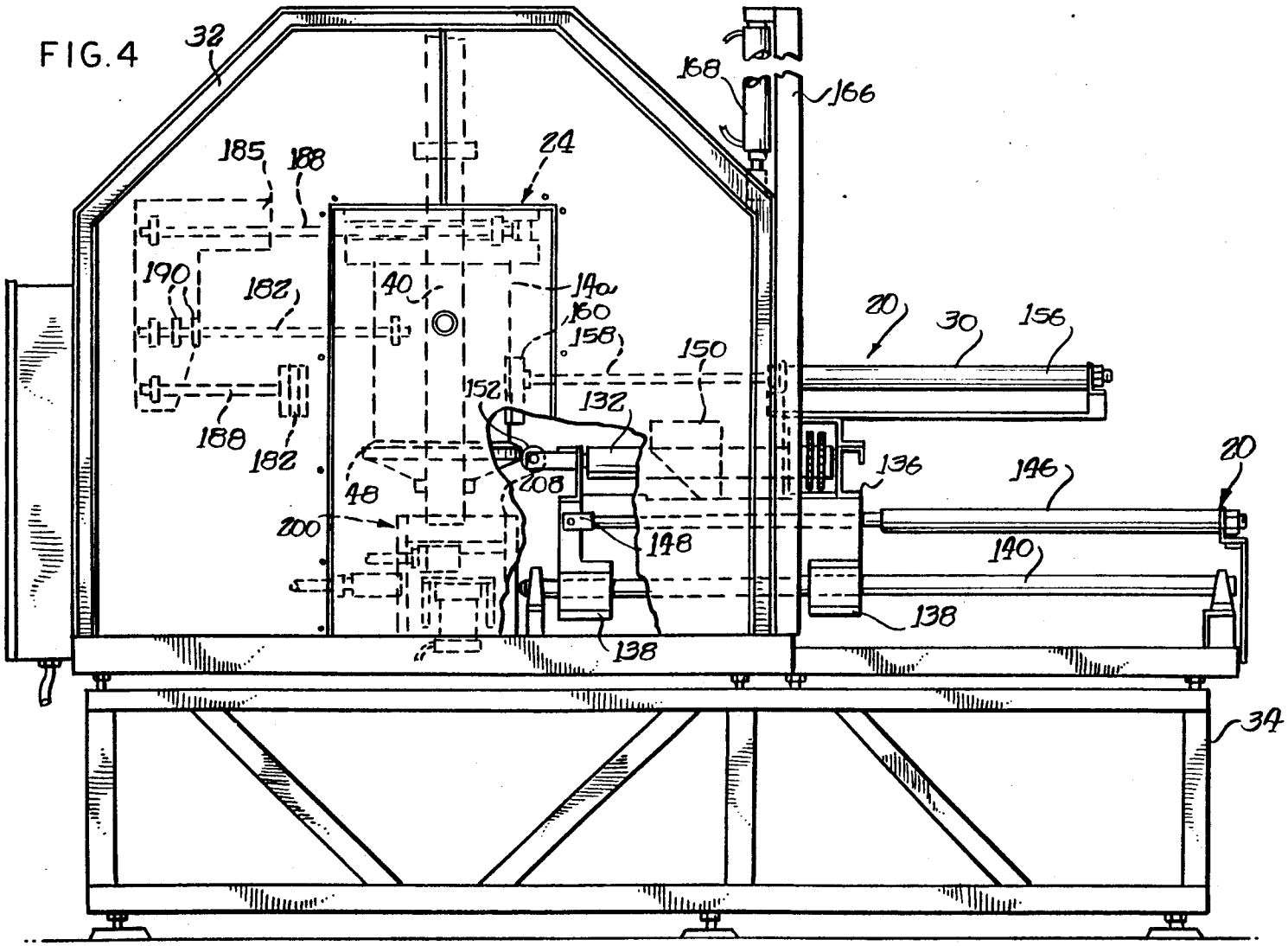
FIG. 4 is a side elevational view of the automatic mixing station of FIG. 1, taken from an upstream position.
Figure 6:
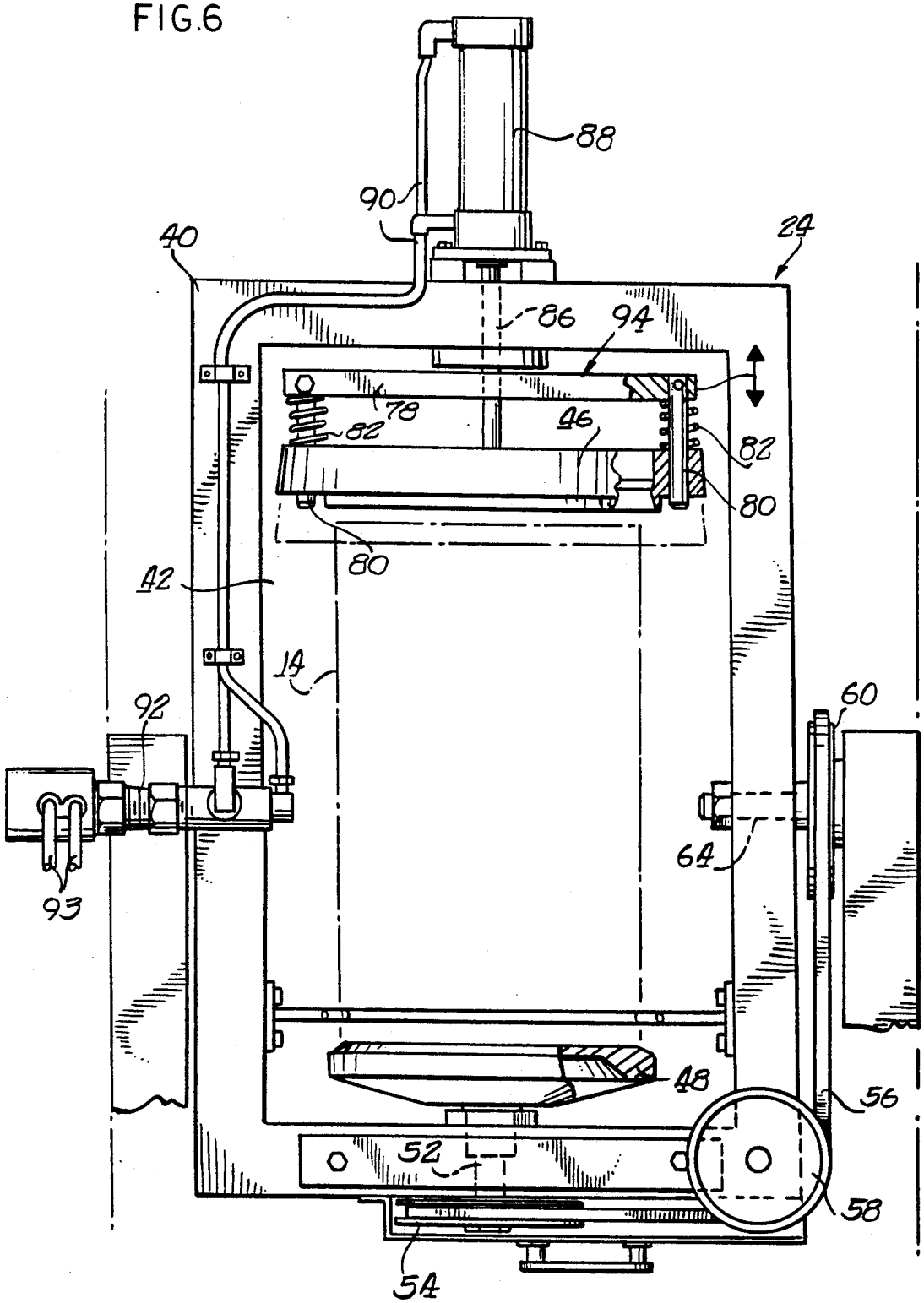
FIG. 6 is a front elevational view of a first embodiment of a mixing apparatus.
Figure 7:
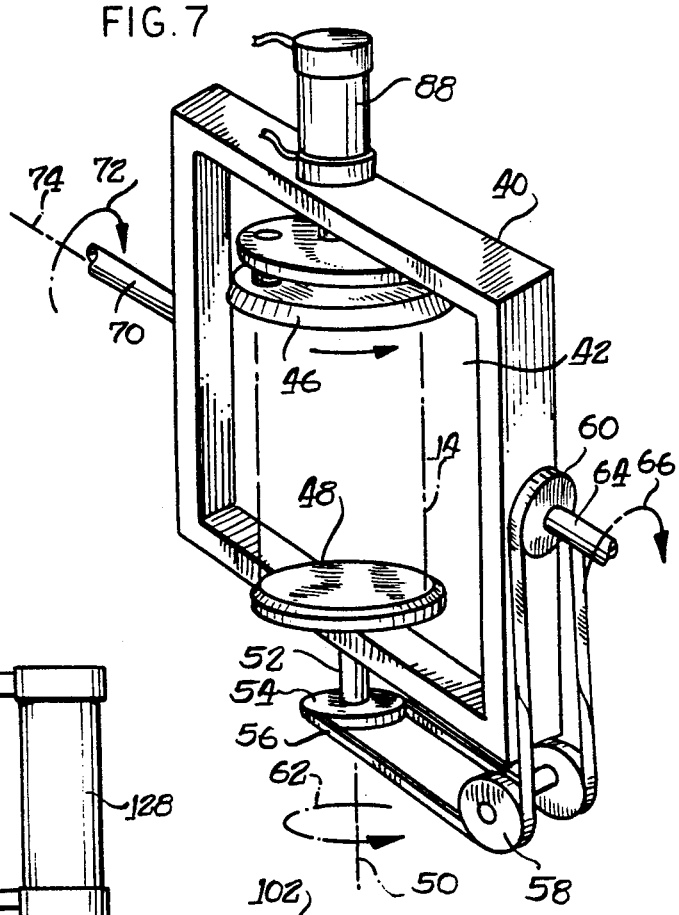
FIG. 7 is a fragmentary view of the mixing apparatus of FIG. 6 indicating the gyroscopic mounting thereof.

Referring now to FIGS. 3 and 4, mixing apparatus 24 is enclosed within a housing 32. The housing 32 and shuttle 20 are mounted atop a support structure 34, although they could be floor-mounted if desired. The mixing mechanism is illustrated in FIGS. 6 and 7 and includes a frame 40 which is generally rectangular in configuration and which defines a cavity 42 for receiving a container 14. The mixing apparatus includes upper and lower clamping plates 46, 48. The clamping plates 46, 48 are rotatably mounted to spin about a first axis 50 (see FIG. 7). The turntable 48 is connected through shaft 52 to a pulley 54. A drive belt 56 traverses pulleys 58, 60 as well as pulley 54 to rotate the lower clamping plate 48 in the direction of arrow 62. Pulley 60 drives belt 56 and receives power from a motor-driven shaft 64 which rotates in a direction of arrow 66.

The shaft 64 is coaxially aligned with a shaft 70 located at the opposite side of frame 40, along an axis 74 which is generally perpendicular to the aforementioned axis 50. The shafts 64, 70 provide a rotatable mounting for frame 40 and the components carried thereon, in the direction of arrow 72. In operation, turntables 46, 48 and the container 14, clamped therebetween, are rotated about axis 50 as the frame and consequently the container 14, clamped therein, are rotated about axis 74, to move container 14 with a gyroscopic motion, which has been found to provide effective mixing of liquid and pulverulent materials within closed containers. In the Preferred Embodiment, the frame 40, turntables 46, 48, the belt drive and pivotal supports, therefore, are adapted from a conventional paint mixer, commercially available from the Harbil Manufacturing Company of Wheeling, IL, which sells the mixer under the description "Five Gallon Auto Gyro Mixer."

Referring again to FIGS. 6 and 7, the preferred mixing apparatus further comprises an actuator plate 78 which carries guide pins 80 which are slidably received within clamping plate 46. Springs 82 are installed on pins 80 and are trapped between actuator plate 78 and clamping plate 46. These springs transmit a controlled clamping force to container 14. Retention means, not shown, prevent clamping plate 46 from sliding past the free ends of pins 80.

Actuator plate 78 is connected to a piston rod 86 of hydraulic cylinder 88 which is mounted to one end of frame 40. The hydraulic cylinder 88 is actuated through hydraulic lines 90 which are connected through slip coupling 92 to lines 93 connected to a source of hydraulic pressure, not shown. When hydraulic cylinder 88 is energized, piston 86 is extended, moving a clamping assembly generally indicated at 94 toward one end of a container 14. The clamping assembly 94 comprises the actuator plate 78, clamping plate 46, pins 80 and springs 82. Extension of piston rod 86 continues after clamping plate 46 contacts container 14, thus compressing springs 82 as the spacing between actuator plate 78 and clamping plate 46 is decreased. Clamping pressure on container 14 is maintained as the container is spun about axis 50, and as frame 40 is spun about axis 74.

Figure 11:
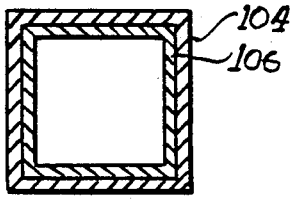
FIG. 11 is a fragmentary cross-sectional view taken along the line 11—11 of FIG. 10.
Figure 12:
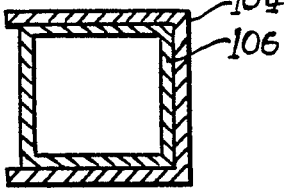
FIG. 12 is a fragmentary cross-sectional view taken along the line 12—12 of FIG. 10.
Figure 10:
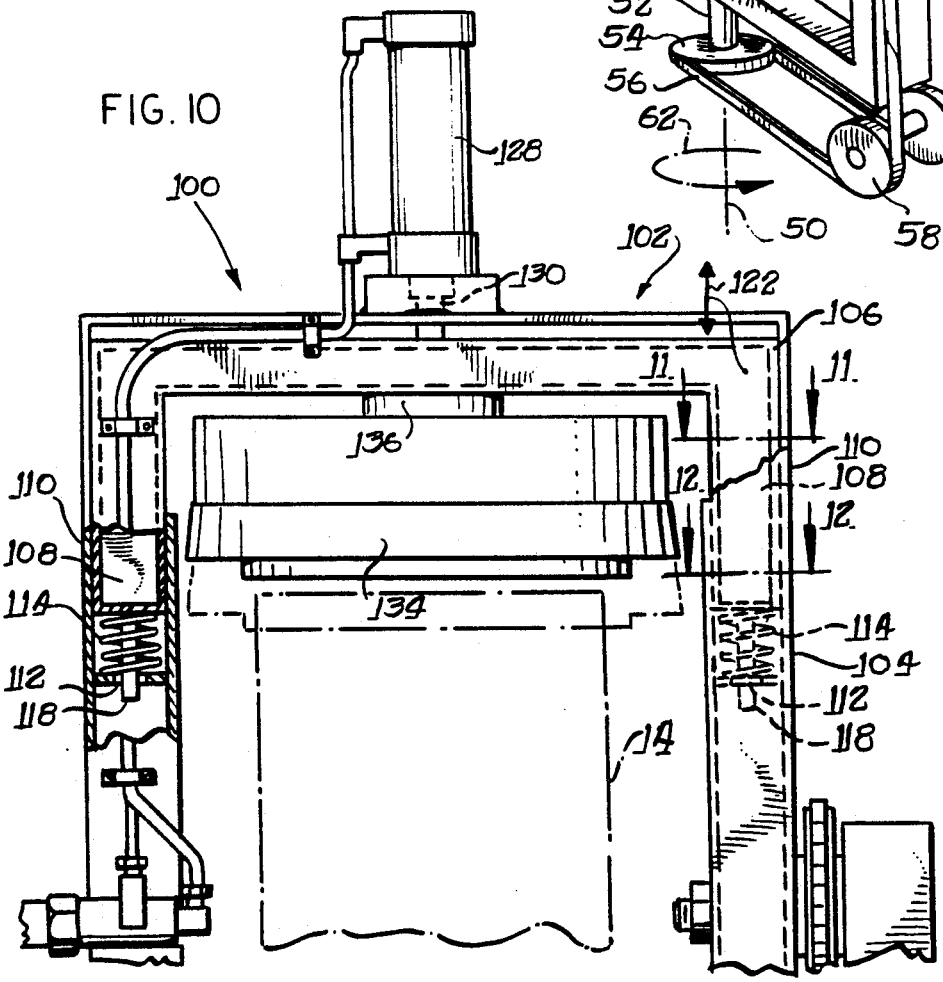
FIG. 10 is a fragmentary elevational view of an alternative embodiment of a mixing apparatus according to principles of the present invention.

Referring now to FIG. 10, an alternative embodiment of the mixing apparatus is generally indicated at 100. The lower portion of mixing apparatus 100 is substantially identical to the mixing apparatus described above in FIGS. 6 and 7, the mixing apparatus of FIG. 10 being distinguished in the manner in which a clamping force is applied to one end of a container 14. The frame 102 of apparatus 100 is generally rectangular and in that manner, resembles the aforementioned frame 40. However, frame 102 is split or divided into two parts, a lower part 104 identical to the lower part of frame 40, and an opposed upper part 106 which is generally U-shaped in configuration, having lower free ends 108 telescopically interfitting with the upper ends of lower frame portion 104. An internal wall 112 provides a support for bias springs 114. The free ends 108 of upper frame portion 106 carry guide pins 118 which extend through springs 114, with lower free ends extending through apertures in internal walls 112. As can be seen in the cross-sectional view of FIG. 11, the outside frame member 104 is generally rectangular in cross-section, as is the internal frame member 106. The internal frame member 106 is mounted for reciprocation in the direction of arrow 122. In order to provide clearance for the bight portion of the U-shaped internal frame 106, the inside facing wall 124 of outside frame 104 (see FIG. 11) is omitted in the upper portion of the outside frame, as illustrated in the cross-sectional view of FIG. 12.

The hydraulic cylinder 128 of apparatus 100 has a piston rod 130 which is secured to interior frame 106 to impart a reciprocation thereto. The upper clamping plate 134 of apparatus 100 is rotatably mounted to interior frame 106 by bearings 136 but is not otherwise movable with respect thereto, the spacing between upper clamping member 134 and the bight portion of interior frame 106 remaining constant, unlike the previous embodiment of the mixing apparatus.

When hydraulic cylinder 128 is energized to extend piston rod 130, interior frame 106 is displaced in a downward direction toward container 14, compressing bias springs 114, and thereby clamping container 14 in frame 102. As an alternative, the clamping plate 134 can be mounted for reciprocation on piston rod 130 and a compressible spring installed to surround bearing 136, the interior housing 106 being advanced toward container 14, bringing the clamping plate 134 in contact with the container. Thereafter, additional pressure can be applied by hydraulic cylinder 128 to compress the optional spring disposed about bearing 136, thereby applying the clamping force through the spring member.

Turning again to FIGS. 3–5, and initially to FIG. 5, shuttle 20 includes a platform of rollers 132 which are arranged at the same level as the rollers 134 of system conveyor 12. Referring to FIGS. 3 and 4, the rollers 132 are mounted in framework 136 which includes sleeve bearings 138 at its lower end. The sleeve bearings 138 travel on guide rails 140 which have forward free ends which extend to the base of mixing apparatus 40. A pneumatic piston 146 has a piston rod connected to the forward end of framework 136 by a clevis member 148.

FIGS. 3 and 4 show opposite side elevational views of mixing apparatus 24, FIG. 3 looking at the apparatus from a downstream point, and FIG. 4 looking at the apparatus from an upstream point. FIG. 3 shows shuttle 20 aligned with the system conveyor, with movable plate 150 mounted to framework 136 so as to block further movement of a container 14, thereby aligning the container on the shuttle. The stop member 150 is pivotally mounted for movement in the direction of arrow 151, being raised and lowered into and out of blocking engagement with containers carried along by the system conveyor. Pneumatic cylinder 146 is energized to extend the piston rod toward mixing apparatus 24, to the position illustrated in FIG. 4. A transition roller, oriented transversely of rollers 132, is carried at the forward end of the shuttle platform, at generally the same level as rollers 132. In the fully extended position illustrated in FIG. 4, transition roller 152 is disposed immediately adjacent the lower clamp plate 48 to provide a substantially continuous surface over which container 14 may slide.

As mentioned above, shuttle 20 carries an insertion actuator 30. Actuator 30 comprises a pneumatic cylinder 156 carried on the rear portion of framework 136 and is aligned in the direction of reciprocation of shuttle 20, that is, in the direction of arrow 32 of FIG. 1. Cylinder 156 includes a piston rod 158 which carries a generally arcuate cradle 160 which, as illustrated, engages the container **14*a*. With operation of pneumatic cylinder 156, cradle 160 and container 14*a* are advanced in the direction of arrow 32. However, pneumatic cylinder 156 is not energized until the shuttle arrives at its fully extended position as illustrated in FIG. 4**.

Figure 2:
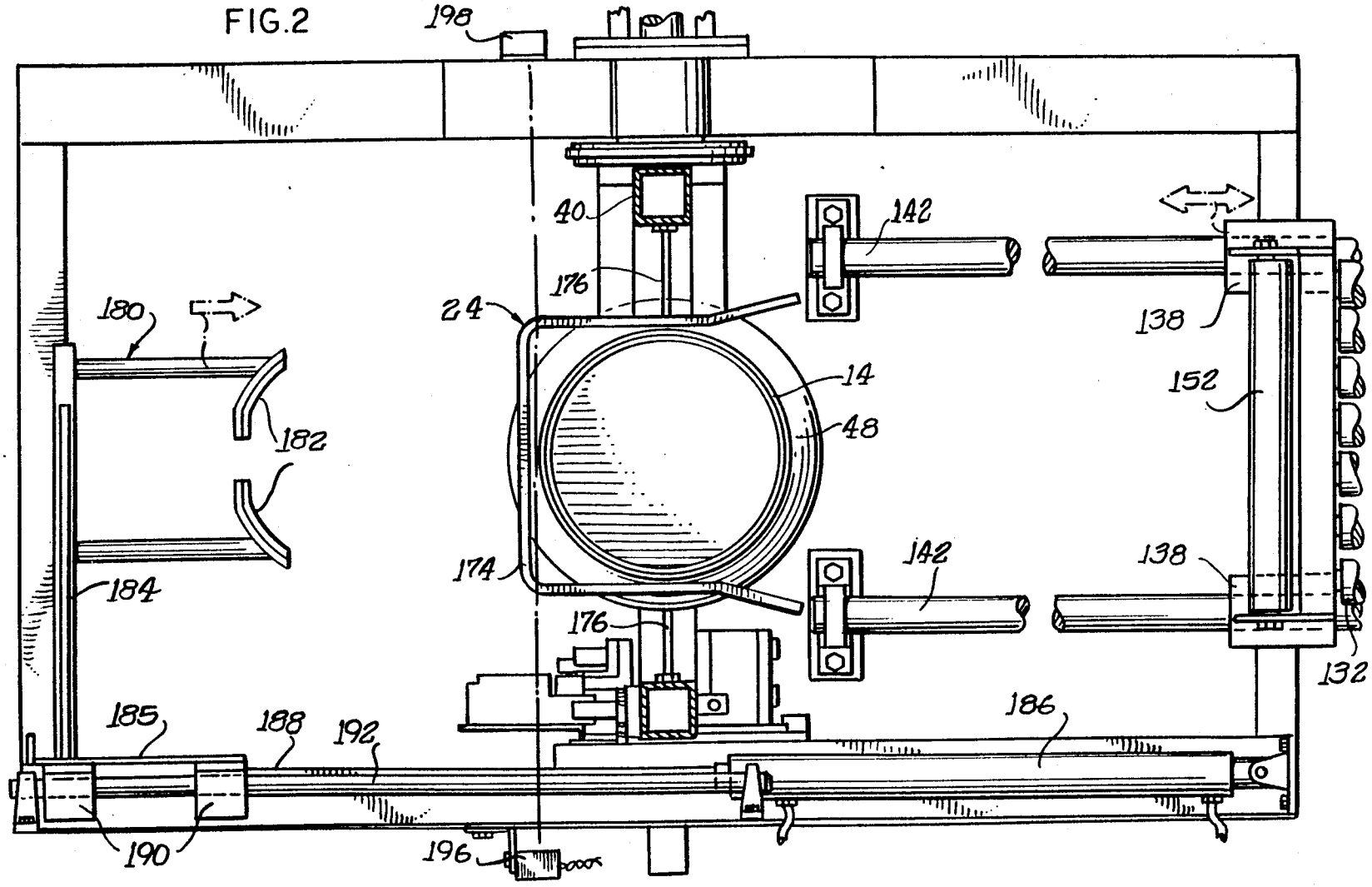
FIG. 2 is an enlarged fragmentary view of the paint mixing apparatus of FIG. 1, shown partly in cross-section.

When piston rod 158 is extended, container **14*a* is pushed from rollers 132, across transition roller 152 to clamping plate 48, the container thereby being inserted in cavity 42 of frame 40. As can be seen in FIG. 2, an alignment cradle 174 is mounted to frame 40 by support rods 176. The cradle 174 is located behind frame 40 and is proportional to receive a container 14, centering the container in the frame. The insertion actuator pushes the container against the cradle 174, and cylinder 156 preferably has a pressure relief, to avoid injury to container. Thus, a container 14 is reliably aligned with the mixing apparatus. Alternatively, the throw of piston rod 158 could be accurately controlled to ensure proper positioning of the container in frame 40. Photoelectric transmitter-receiver elements 196, 198 detect the presence of a container 14 in cradle 174** and are employed to issue a permissive signal to control circuitry governing the operation of the mixing apparatus.

Figure 5:
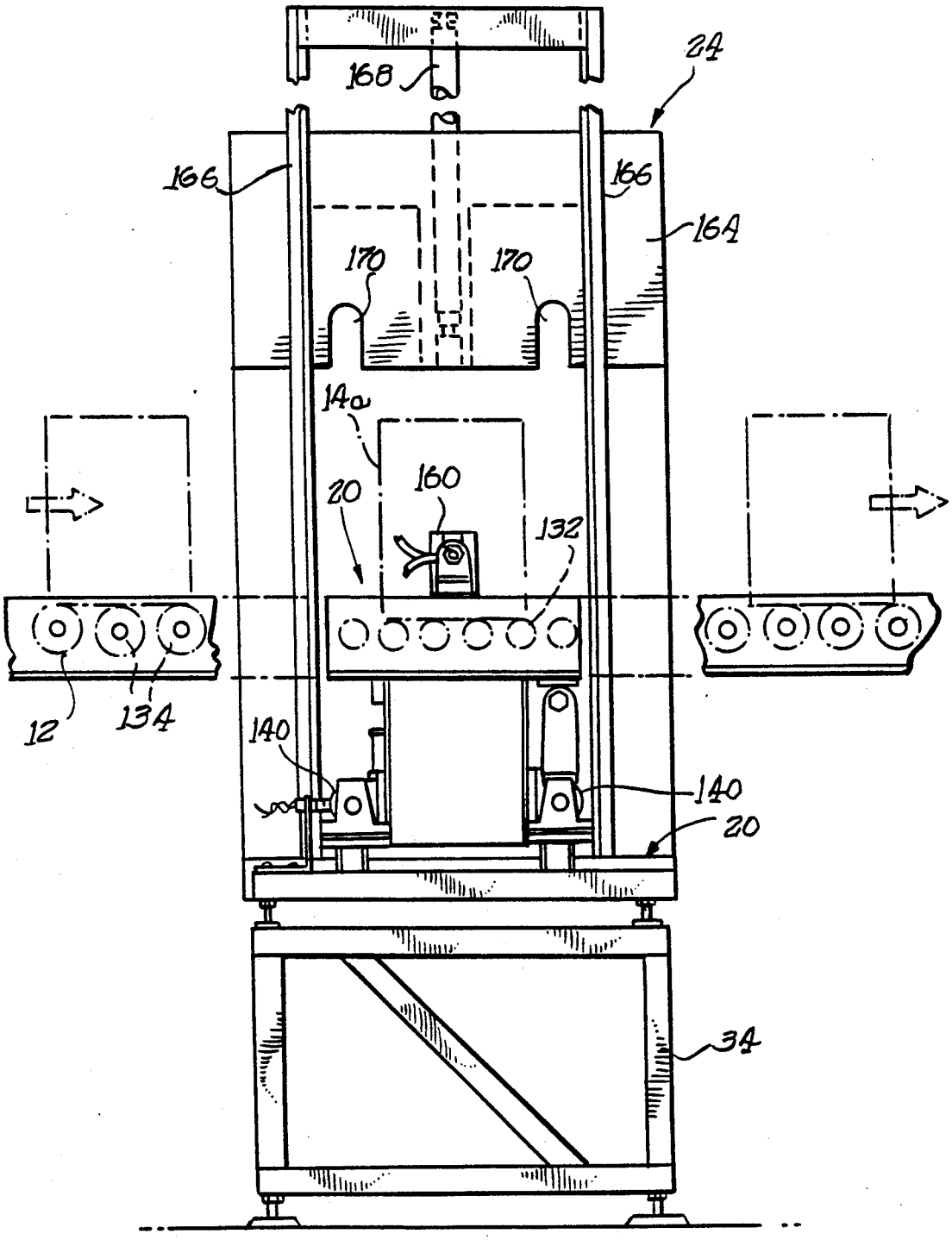
FIG. 5 is a front elevational view of the automatic mixing station of FIG. 1.

Thereafter, the hydraulic cylinder 88 is energized to clamp the container in position within the mixing apparatus. As operation of the paint mixing station continues, shuttle 20 is retracted to the position illustrated in FIGS. 1 and 3. A door 164, visible in FIG. 5, is mounted for vertical reciprocation on guide tracks 166. A pneumatic cylinder 168 raises and lowers door 164.

When shuttle 20 is fully retracted, hydraulic cylinder 168 is energized to lower door 164 into position, thereby enclosing the mixing apparatus 24 in a sealed chamber. As can be seen in FIG. 5, door 164 includes notches 170 for receiving the guide rails 140, thus providing a complete sealing for the interior of housing 32. When door 164 is lowered in position, mixing apparatus 24 is energized, moving container 14 clamped therein with a gyroscopic motion. At the end of the mixing operation, the frame 40 is returned to a reference position as illustrated in FIGS. 3 and 4, ready to eject the container onto shuttle 20, and to receive a second container. Alignment and braking apparatus for the frame will be described below.

After mixing of a container 14, the container is discharged from the mixing apparatus, being loaded onto shuttle 20 for transport in line with the system conveyor 12. Ejection apparatus is generally indicated at 180 and, as can be seen in FIG. 2, includes cradle member 182 mounted to a cantilever support 184. A pneumatic cylinder 186 is mounted to housing 32 and includes a piston rod 188 connected to support 184. Slide bearings 190 attached to support 184 slide along guide bar 192.

At the end of a mixing operation, the door 164 is raised to an open position and shuttle 20 is advanced to the position illustrated in FIG. 4, with transition roller 152 located adjacent the lower clamping plate 48. The pneumatic cylinder 186 is then actuated to retract piston rod 188 thereby advancing the container past transition roller 152 onto rollers 132 of the shuttle platform. The shuttle is then retracted, bringing the container in line with the system conveyor. The pneumatic cylinder 186 is extended to the position illustrated in FIG. 2, to prepare for reception of another container in the mixing apparatus.

A bracket 185 joins the support structure 84 to the sliding bearings 190.

Figure 8:
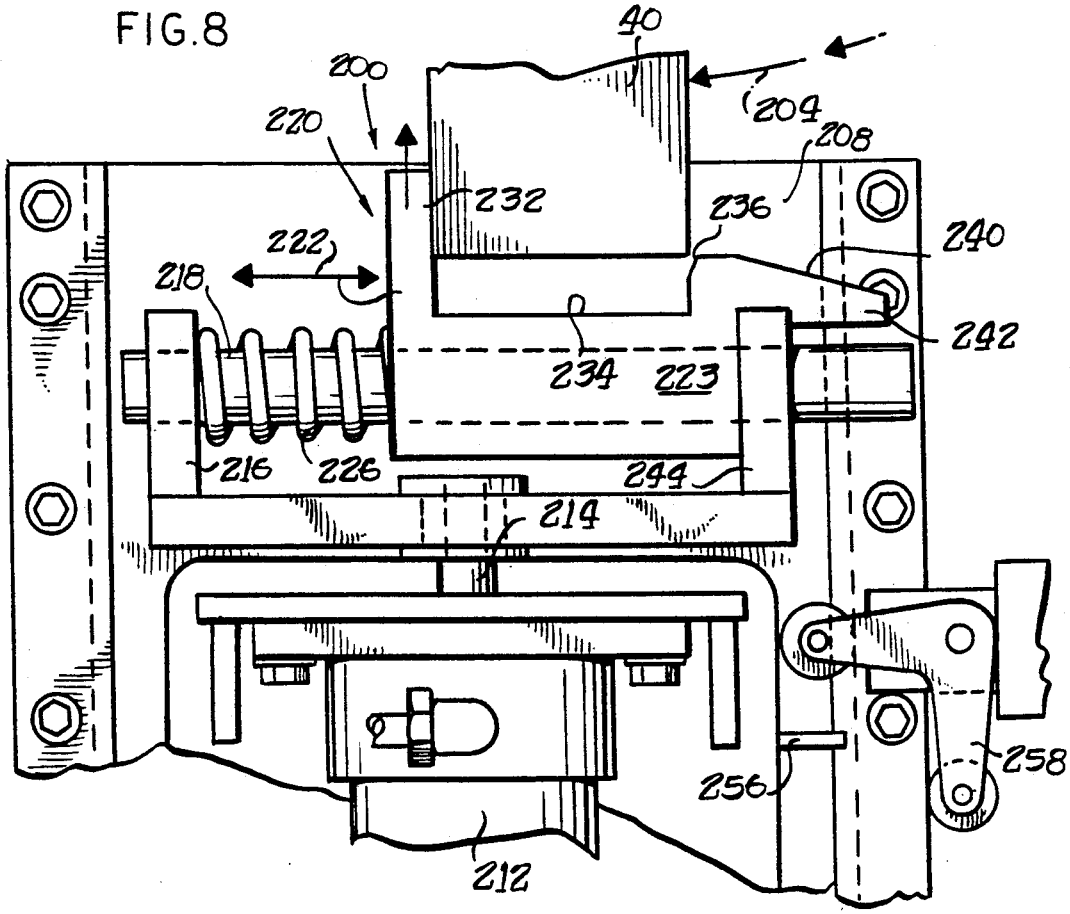
FIG. 8 is a fragmentary side elevational view of the mixing apparatus showing an alignment and braking system therefor.
Figure 9:
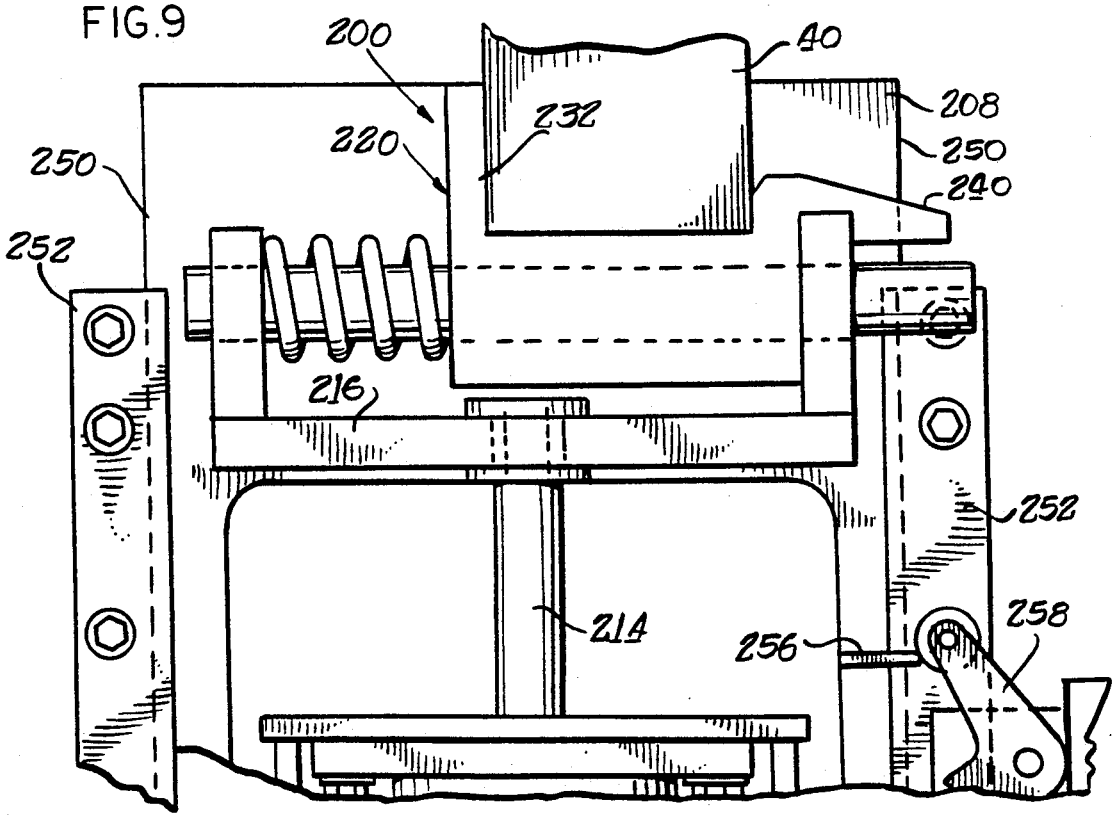
FIG. 9 is a fragmentary side elevational view similar to that of FIG. 8 but showing the alignment and braking system in a fully locked position.

Turning now to FIGS. 8 and 9, a braking and alignment mechanism is generally indicated at 200 and is provided to prepare frame 40 for transfer of containers to and from the shuttle 20. As mentioned, frame 40 is mounted for swinging movement, being driven for rotation about axis 74 (see FIG. 7). At the end of a mixing operation, the drive for rotating frame 40 is discontinued, and the frame coasts to slower speeds. Without intervention, the frame may come to rest at an undesired position, other than that illustrated in FIGS. 2–4. The frame 40 defines a cavity for receiving a container, and as been seen above, the container is slid into and out of position on clamping plate 48. It is important that the support surface of plate 48 be generally coplanar aligned with the rollers of shuttle 20 to facilitate the sliding loading and unloading. Also, production capacity of the mixing apparatus can be increased if a minimal amount of time is taken to decelerate and align frame 40 in preparation for a container transfer operation.

Accordingly, there is provided the braking and alignment mechanism 200 located at the bottom of housing 32, beneath frame 40. As power is terminated from spinning frame 40, the frame coasts to a slower speed in the direction of arrow 204, as illustrated in FIG. 8. As will be appreciated by those skilled in the art, the rotational momentum of the frame, clamping members and a filled container can be very substantial, particularly for containers of five-gallon size filled with paint, masonry sealing compound, or dry pulverulent materials such as cement mixes. The mechanism 200 remains out of contact with frame 40 until the frame coasts to a suitably slow speed, whereupon the mechanism is actuated for upward movement, into engagement with the lower end of frame 40.

As can be seen in FIG. 9, the mounting wall 208 is slidably supported at each lateral edge 250 by guide channels 252. A projection 256 is mounted to wall 208 and trips a switch mechanism 258 indicating that the frame is stopped and aligned in a desired fashion. A pneumatic cylinder 212 is mounted to wall 208 and includes a piston rod 214 for reciprocation in vertical directions. A yoke member 216 is mounted at the free end of piston rod 214 and supports a guide rod 218 between its opposed walls. A body member 220 is mounted for sliding reciprocation on shaft 218, in the direction of arrow 222.

Body member 220 includes an upstanding stop member or wall 232, a recess or channel 234 dimensioned to receive the bottom end of frame 40 with a relatively close tolerance fit, and an inclined braking surface 240 of a forwardly located brake shoe portion 242. A bevelled edge 236 is provided to guide frame 40 into channel 234. A spring 226 biases body 220 in a direction which opposes the rotation of frame 40.

As frame 40 decelerates and is within ½ revolution of its final orientation, pneumatic cylinder 212 is energized to raise the body 220, such that the wall 232 thereof blocks the path of travel of the frame, as illustrated in FIG. 8. The impact of frame 40 against wall 232 causes the body 220 to slide on shaft 218, compressing spring 226 which absorbs the rotational momentum of the frame and its related components. In a short time the spring 226 reverses the direction of movement of the frame and the body 220, to the position illustrated in FIG. 8, wherein the forward end 223 of body 220 contacts wall 244 of yoke member 216. Channel 234 is aligned with the bottom portion of frame 40. Thereafter, the pneumatic cylinder 212 is energized for additional extension, to move the body member 220 into secure engagement with the frame 40, as illustrated in FIG. 9. The bevel 236 facilitates a rapid, easy mating of the frame and channel.

As can be seen from the above, spring 226 provides a shock absorbing function, dissipating the rotational momentum of frame 40. If additional shock absorption is desired, the pneumatic cylinder 212 can be initially extended a slightly greater amount than that indicated above, such that the inclined surface 240 of body 220 blocks the path of travel of frame 40, the frame initially contacting the inclined braking surface 240, forcing mechanism 220 in a downward direction, which is resisted by hydraulic cylinder 212, thus providing an additional dissipation of rotational energy. As frame 40 begins its final deceleration, due to contact with inclined surface 240, its leading edge clears the inclined surface, being free to travel to back wall 232 where the aforedescribed energy dissipation is realized by spring 226. As can be seen in FIGS. 8 and 9, the inclined surface 240 is provided on a finger-like extension or brake shoe portion 242 which extends beyond the adjacent upstanding wall 244 of yoke member 216. The wall 244 is slotted to provide a guide channel for finger 244 as body 220 reciprocates during compression and expansion of spring 226. The wall 244 provides additional support for brake shoe portion 242, to help withstand the initial impact caused by contact of back wall 232 with the rotating frame 40.

To summarize operation of the mixing station, a container 14 is advanced along the system conveyor until it contacts the stop member 150, stopping the container so that it lies on the rollers 132 of shuttle 20. With the door 164 raised to an open position (see FIG. 5), the pneumatic cylinder 146 is energized to move the shuttle to its extended position as illustrated in FIG. 4. Thereafter, the pneumatic cylinder 156 is extended to push container 14 from rollers 132 onto lower clamp plate 48, as illustrated in FIG. 4. The pneumatic cylinders 156, 146 are then retracted and shuttle 20 is withdrawn from housing 32. The pneumatic cylinder 168 is operated to close door 164, and pneumatic cylinder 88 is operated to clamp container 14 between plates 46, 48.

Belt 56 is driven to spin the container 14 about its central axis, while frame 40 is driven to spin in the direction of arrows 66 or 72 (see FIG. 7). This imparts a gyroscopic motion to container 14, mixing the contents thereof. At the end of a mixing cycle, drive to the base plate 48 and frame 40 is discontinued, and the frame assembly is allowed to coast to a lower speed. At an appropriate time, namely when frame 40 is at a half revolution away from its final desired position, pneumatic cylinder 212 is energized to bring inclined surface 240 in the path of travel of frame 40.

The frame 40 contacts the inclined surface 240, lowering the mechanism 200, working the piston rod 214 of the pneumatic cylinder to provide an initial braking. Thereafter, the frame 40 contacts wall 232 of the mechanism and spring 226 is compressed, further decelerating frame 40 and reversing its direction of rotation a slight amount to assume the desired aligned position with the base plate 48, being generally coplanar aligned with the rollers 132 of shuttle 20. Thereafter, pneumatic cylinder 212 is extended further to lock frame 40 in the channel 234 (see FIG. 9). With frame 40 locked in position, door 164 is raised and pneumatic cylinder 186 is energized to retract its piston rod 188, thus bringing cradle parts 182 into engagement with container 14.

Pneumatic cylinder 146 is energized to extend shuttle 20 to the position illustrated in FIG. 4, ready to receive the container 14 which has just been mixed. Pneumatic cylinder 88 is energized to release clamping pressure on cylinder 14 and retraction of piston rod 188 continues, causing container 14 to be slid from support plate 48 onto the rollers 132 of shuttle 20. When container 14 is loaded onto the shuttle, the pneumatic cylinder 186 is again energized to extend piston rod 188 to return cradle parts 182 to their stored position.

Pneumatic cylinder 146 is then operated to retract its piston rod, returning shuttle 20 into alignment with the system conveyor. Thereafter, the stop member 150 is rotated, free of interference with the container 14 which passes in a downstream direction. At the same time a new container 14 traverses the upstream portion of system conveyor 12, travelling onto the rollers 132 of shuttle 20, the stop member 150 being raised to retain the container on the shuttle. The cycle is then repeated for subsequent mixing operations.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. An automated apparatus for mixing ingredients stored in closed containers, comprising:

a frame means defining a container receiving cavity;

frame support means for movably supporting the frame means for movement in a mixing motion;

shuttle means for carrying a container to said frame, including a shuttle platform for supporting the container and shuttle moving means for moving said shuttle platform toward and away from said frame means;

inserting means for inserting a container carried by said shuttle platform into the cavity of said frame means;

clamping means for clamping the container within said frame means to maintain engagement therewith during a mixing operation;

drive means for moving said frame means with a mixing motion so as to agitate the contents of a container clamped therein; and ejecting means for ejecting the container from said frame means onto said shuttle platform.

2. The apparatus of claim 1 further comprising alignment means for aligning the container within said frame means.

3. The apparatus of claim 2 wherein said alignment means comprises a stop member mounted on said frame means, having a concave container-engaging surface.

4. The apparatus of claim 1 wherein said shuttle moving means comprises guide rails for supporting said platform, extending from a first location remote from said frame means to a second location adjacent the frame means.

5. The apparatus of claim 1 wherein said inserting means comprises an extendable arm carried on said platform, extendable toward the cavity of the frame means.

6. The apparatus of claim 1 further comprising frame alignment means for aligning the frame means with respect to the shuttle means to prepare the frame means to receive a container carried on the shuttle means.

7. The apparatus of claim 6 wherein said frame support means and said drive means cooperate to gyroscopically rotate said frame means.

8. The apparatus of claim 6 wherein said frame alignment means comprises braking means to stop movement of said frame means at a desired position.

9. The apparatus of claim 8 wherein said braking means comprises a brake shoe mounted on a brake piston which is extendable toward and away from said frame means.

10. The apparatus of claim 9 wherein said frame alignment means comprises a stop member carried on said brake piston along with said brake shoe, said piston moving said stop member into and out of the path of travel of said frame means.

11. The apparatus of claim 10 wherein said stop member is positioned such that said frame means contacts said brake shoe before contacting said stop member, said stop member including shock absorber means to absorb any moving energy of said frame means not absorbed by said brake shoe.

12. The apparatus of claim 11 wherein said shock absorber means comprises spring means deformed in response to movement of said stop member caused by contact with said frame means.

13. The apparatus of claim 11 wherein said stop member and said brake shoe cooperate to define a recess therebetween, proportioned to receive one end of said frame means, said brake piston moving one end of the frame means into the recess.

14. The apparatus of claim 1 wherein said frame means comprises first and second opposed portions slidably connected together so as to define said container receiving cavity.

15. The apparatus of claim 14 wherein said clamping means comprises a pressure plate rigidly connected to said first frame portion and piston means mounted to said second frame portion so as to move said first and second frame portions together.

16. The apparatus of claim 15 further comprising spring means urging said first and second frame portions away from one another.

17. The apparatus of claim 1 wherein said ejecting means comprises a pusher member having a concave container engaging surface and piston means for moving said pusher member toward said shuttle means.

18. The apparatus of claim 1 wherein said clamping means comprises piston means mounted to said frame means for movement into said cavity.

19. An automated apparatus for use in an automated production facility to mix the liquid ingredients stored in series of closed containers, comprising:

conveyor means for transporting a series of containers through the production facility, the conveyor means including first and second portions spaced apart to form a gap therebetween;

a frame means adjacent the main conveyor defining a container receiving cavity;

frame support means for movably supporting the frame means for movement in a mixing motion;

shuttle means for carrying a container from said main conveyor to said frame means, including a shuttle platform in the gap between the first and second conveyor portions for receiving the container from the first conveyor portion, for supporting the container for movement to and from the frame means and for returning the container to the second conveyor portion, and said shuttle means further comprising shuttle moving means for moving said shuttle platform between said conveyor and said frame means;

inserting means for inserting a container carried by said shuttle means into the cavity of said frame means;

clamping means for clamping the container within said frame means to maintain engagement therewith during a mixing operation;

drive means for moving said frame means with a mixing motion so as to agitate the contents of a container clamped therein; and means for ejecting the container from said frame means onto said shuttle platform.

20. The apparatus of claim 19 further comprising alignment means for aligning the container within said frame means, comprising a stop member mounted on said frame means, having a concave container-engaging surface.

21. The apparatus of claim 19 wherein said inserting means comprises an extendable arm carried on said platform, extendable toward the cavity of the frame means.

22. The apparatus of claim 19 further comprising frame alignment means for aligning the frame means with respect to the shuttle means to prepare the frame means to receive a container carried on the shuttle means, comprising braking means to stop movement of said frame means at a desired position.

23. The apparatus of claim 22 wherein said frame alignment means comprises braking means to stop movement of said frame means at a desired position.

24. The apparatus of claim 23 wherein said braking means comprises a brake shoe mounted on a brake piston which is extendable toward and away from said frame means.

25. The apparatus of claim 24 wherein said frame alignment means further comprises a stop member carried on said brake piston along with said brake shoe, said piston moving said stop member into and out of the path of travel of said frame means.

26. The apparatus of claim 25 wherein said stop member is positioned such that said frame means contacts said brake shoe before contacting said stop member, said stop member including shock absorber means to absorb any moving energy of said frame means not absorbed by said brake shoe.

27. The apparatus of claim 26 wherein said shock absorber means comprises spring means deformed in response to movement of said stop member caused by contact with said frame means.

28. The apparatus of claim 25 wherein said stop member and said brake shoe cooperate to define a recess therebetween, proportioned to receive one end of said frame means, said brake piston moving one end of the frame means into the recess.

29. The apparatus of claim 22 wherein said frame support means and said drive means cooperate to gyroscopically rotate said frame means.

30. The apparatus of claim 19 wherein said clamping means comprises piston means mounted to said frame means for movement into said cavity.

31. The apparatus of claim 19 wherein said frame means comprises first and second opposed portions slidably connected together so as to define said container receiving cavity.

32. The apparatus of claim 31 wherein said clamping means comprises a pressure plate rigidly connected to said first frame portion and piston means mounted to said second frame portion so as to move said first and second frame portions together.

33. The apparatus of claim 32 further comprising spring means urging said first and second frame portions away from one another.

* * * * *

UNITED STATES PATENT AND TRADEMARK OFFICE

CERTIFICATE OF CORRECTION

PATENT NO. : 5,116,134

DATED : May 26, 1992

INVENTOR(S) : Kenneth N. Edwards, et al

It is certified that error appears in the above-identified patent and that said Letters Patent is hereby corrected as shown below:

Column 12, line 30, (Claim 24), change the numeral "22" to read --19--.

Signed and Sealed this

Fifth Day of October, 1993

*Attest:*

Bruce Lehman

BRUCE LEHMAN

*Attesting Officer*

*Commissioner of Patents and Trademarks*